US010058971B2

(12) United States Patent
Hildebrandt et al.

(10) Patent No.: US 10,058,971 B2
(45) Date of Patent: Aug. 28, 2018

(54) DEVICE FOR BAND FINISHING A WORKPIECE

(71) Applicant: Supfina Grieshaber GmbH & Co. KG, Wolfach (DE)

(72) Inventors: Oliver Hildebrandt, Hornberg (DE); Simon Wolber, Schiltach (DE)

(73) Assignee: SUPFINA GRIESHABER GMBH & CO. KG, Wolfach (DE)

( * ) Notice: Subject to any disclaimer, the term of this patent is extended or adjusted under 35 U.S.C. 154(b) by 289 days.

(21) Appl. No.: 14/890,947

(22) PCT Filed: Mar. 31, 2014

(86) PCT No.: PCT/EP2014/056396
§ 371 (c)(1),
(2) Date: Nov. 13, 2015

(87) PCT Pub. No.: WO2014/183914
PCT Pub. Date: Nov. 20, 2014

(65) Prior Publication Data

US 2016/0101496 A1 Apr. 14, 2016

(30) Foreign Application Priority Data

May 14, 2013 (EP) ..... 13167681

(51) Int. Cl.
*B24B 21/00* (2006.01)
*B24B 35/00* (2006.01)

(52) U.S. Cl.
CPC ..... *B24B 21/00* (2013.01); *B24B 35/00* (2013.01)

(58) Field of Classification Search
CPC ..... B24B 35/00; B24B 5/423; B24B 21/02; B24B 21/08; B24B 21/18
See application file for complete search history.

(56) References Cited

U.S. PATENT DOCUMENTS 3,911,627 A * 10/1975 Heesemann ..... B24B 21/08 451/299
2002/0086627 A1* 7/2002 Andrews ..... B24B 21/02 451/355
2010/0236314 A1 9/2010 Weigmann et al.

FOREIGN PATENT DOCUMENTS

CN 101903130 A 12/2010
CN 102781625 A 11/2012
(Continued)

OTHER PUBLICATIONS

Machine Translation of DE4419366A1.*

*Primary Examiner* — Monica Carter
*Assistant Examiner* — Lauren Beronja
(74) *Attorney, Agent, or Firm* — Leydig, Voit & Mayer, Ltd.

(57) ABSTRACT

A device for finishing a workpiece includes two pressing elements and a holding apparatus for holding the pressing elements. A finishing band is pressable against a workpiece surface to be finished. A flexurally resilient intermediate element is disposed so as to transmit a pressing force to the finishing band by means of a force-receiving surface and by means of a force-transmitting surface. The intermediate element or a plurality of them is configured to transmit pressing forces, which are offset relative to one another in a circumferential direction of the workpiece surface, to the finishing band. The force-transmitting surfaces of the intermediate element or the plurality of them are oriented in a substantially V-shaped manner relative to one another, and are substantially planar in an undeformed initial state and have a curvature in a same direction as the workpiece surface when there is a pressing force.

16 Claims, 5 Drawing Sheets

(56) References Cited

FOREIGN PATENT DOCUMENTS

| | | | | | |
|---|---|---|---|---|---|
| DE | 4419366 | A1 | * | 12/1995 | ..... B24B 5/423 |
| DE | 19622116 | A1 | | 12/1997 | |
| DE | 10332605 | A1 | | 2/2005 | |
| DE | 202010006480 | U1 | | 8/2010 | |
| EP | 0161748 | A2 | | 11/1985 | |
| EP | 2212058 | B1 | | 8/2010 | |

* cited by examiner

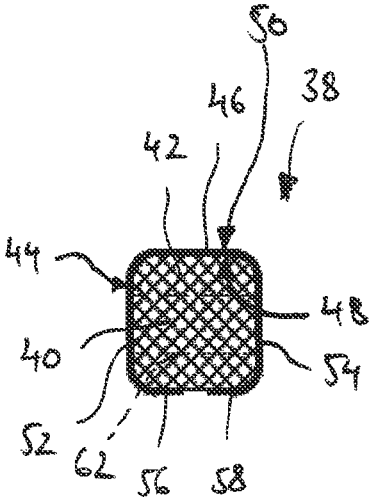
Fig. 2
Fig. 1
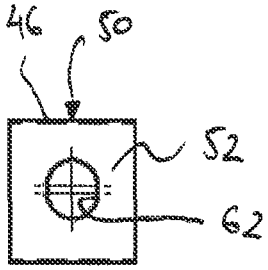
Fig. 3
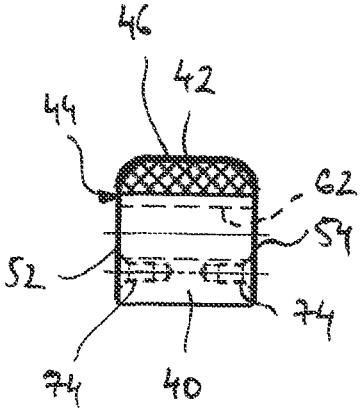
Fig. 4
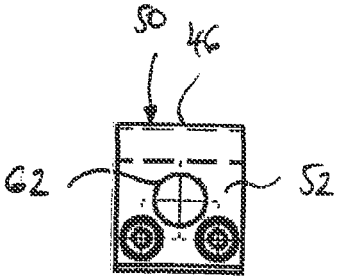
Fig. 5

DEVICE FOR BAND FINISHING A WORKPIECE

CROSS-REFERENCE TO PRIOR APPLICATIONS

This application is a U.S. National Stage Application under 35 U.S.C. § 371 of International Application No. PCT/EP2014/056396 filed on Mar. 31, 2014, and claims benefit to European Patent Application No. 13 167 681.9 filed on May 14, 2013. The International Application was published in German on Nov. 20, 2014 as WO 2014/183914 A1 under PCT Article 21(2).

FIELD

The invention relates to a device for band finishing a workpiece, comprising a holding apparatus for holding at least one pressing element, and a finishing band that can be pressed against a workpiece surface to be finished at the height of the pressing element by means of the pressing element.

BACKGROUND

Finishing a workpiece is a process for the surface treatment of a workpiece which is also known as "superfinishing" or a "microfinishing process". In this process, a finishing tool which has an abrasive effect, for example a finishing stone or a finishing band, is pressed against the workpiece surface to be treated. In the process, the workpiece surface to be treated rotates. An oscillating movement is superimposed on this rotation of the workpiece surface to be treated, in which oscillating movement the finishing tool and the workpiece surface to be treated move relative to each other in directions parallel to the axis of rotation.

DE 20 2010 006 480 U1 and EP 0 161 748 A2 describe band finishing devices which comprise pressing elements which in each case press a finishing band against a workpiece surface to be finished at the height of a pressing element.

DE 20 2010 006 480 U1 proposes using rigid or comparatively soft and yielding pressing elements. The use of rigid pressing elements has the advantage that imprecisions in an initial geometry of a workpiece to be treated can be compensated at least in part. However, compensation of this kind is limited by the resilience of the finishing band. The use of soft and yielding pressing elements permits planar contact of the finishing band on the workpiece, but has the disadvantage that the pressing elements can deform significantly, in particular in the region of oil outlet holes of a crankshaft, and lead to too much material removal in this region. The oscillating and rotating movement of the workpiece also produces comparatively significant deformation of a soft pressing element, which makes it more difficult to treat a workpiece in a dimensionally stable manner.

EP 2 212 058 B1 discloses a further band finishing device. In this case, a pressing band is provided which supports the rear side of a finishing band. The pressing band is fastened to two bearings which are arranged so as to be spaced apart such that the pressing band wraps around the workpiece over a partial circumference. Although this permits contact of a finishing band over a large contact area, the available pressing forces are relatively low and are unevenly distributed over the partial circumference.

DE 44 19 366 A1 discloses a finishing machine in which pressure bodies are used which have a cup-shaped pressure body main part which is open towards the workpiece and on which a spring plate is placed.

SUMMARY

In an embodiment, the present invention provides a device for finishing a workpiece. The device includes two pressing elements and a holding apparatus configured to hold the pressing elements such that the pressing elements are distributed about a partial circumference of a workpiece surface. A finishing band is pressable against a workpiece surface to be finished at a height of the pressing elements by means of the pressing elements. A flexurally resilient intermediate element is disposed so as to transmit a pressing force from one of the pressing elements to the finishing band by means of a force-receiving surface and by means of a force-transmitting surface. The intermediate element or a plurality of the intermediate elements are configured to transmit pressing forces, which are offset relative to one another in a circumferential direction of the workpiece surface, to the finishing band. The force-transmitting surfaces of the intermediate element or of the plurality of the intermediate elements assigned to different ones of the pressing elements are oriented in a substantially V-shaped manner relative to one another. The force-transmitting surfaces are substantially planar in an undeformed initial state and have a curvature in a same direction as the workpiece surface in a state in which a pressing force is transmitted.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 2 is a side view of a part of the device according to FIG. 1, comprising a pressing element and intermediate element assembly;

FIG. 3 is a side view of the assembly according to FIG. 2, when viewed rotated by 90°;

FIG. 4 is a side view of a further embodiment of a pressing element and intermediate element assembly;

FIG. 5 is a side view of the assembly according to FIG. 4, when viewed rotated by 90°;

DETAILED DESCRIPTION

Figure 1:
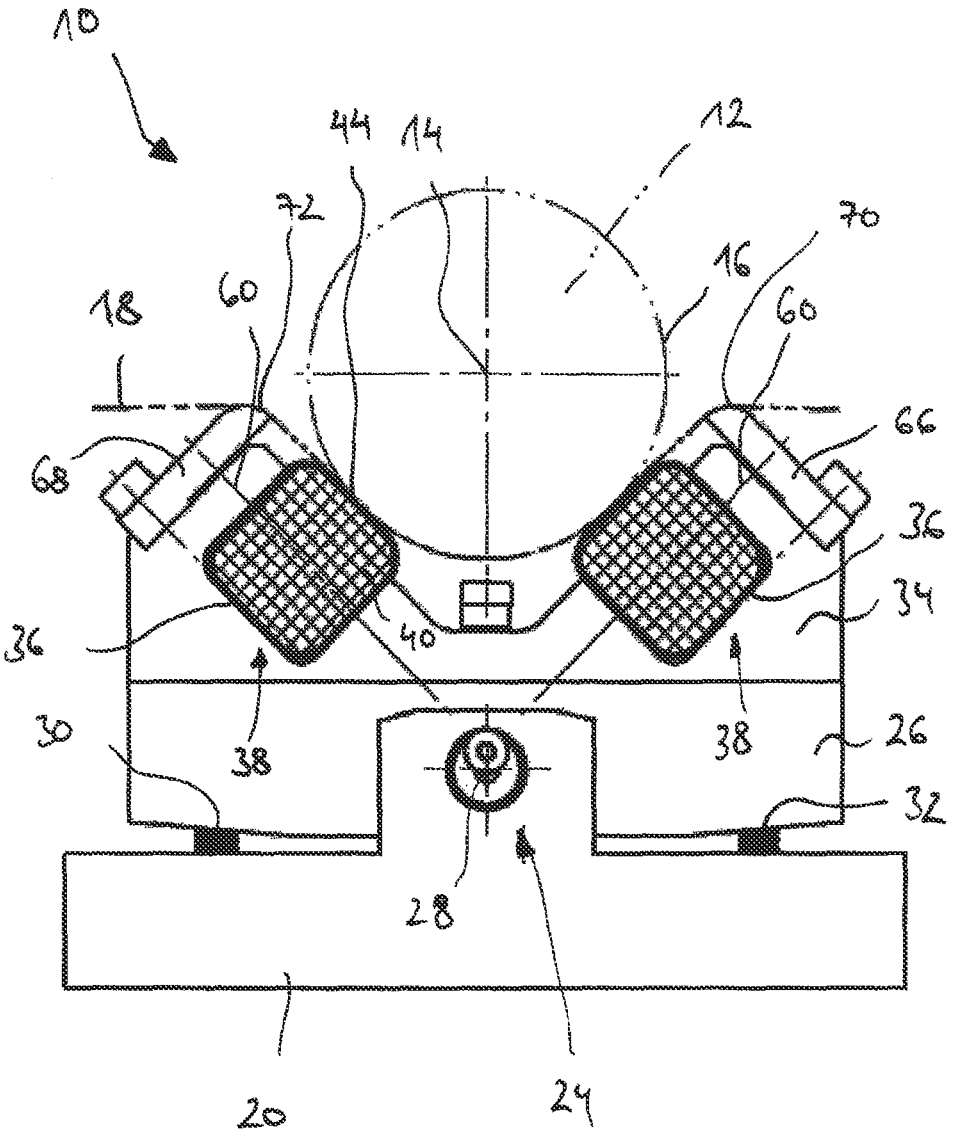
FIG. 1 is a side view of a first embodiment of a device for finishing a workpiece.

In an embodiment, the present invention improves a device of the type mentioned at the outset in such a way that high pressing forces can be provided, irrespective of the initial geometry of a workpiece surface to be treated.

In the device according to an embodiment of the invention, a flexurally resilient intermediate element is provided, which is arranged between a pressing portion of the pressing element and the finishing band. A force exerted on the holding apparatus is therefore not directly transmitted from the pressing portion of the pressing element to the rear side of a finishing band, but rather through the interposition of the intermediate element. Said element comprises a force-receiving surface on which the pressing portion of the pressing element acts, and a force-transmitting surface which transmits a force to the rear side of the finishing band. The front side of the finishing band has an abrasive effect, and removes material when in contact with a workpiece. The device permits good contact between the finishing band and the shape of the workpiece, and an even distribution of the pressing force. At the same time, the intermediate element prevents too great a deformation of a pressing element, and too much material removal in the region of an oil outlet hole of a crankshaft is thereby prevented. The deformation of the pressing element due to the rotating and oscillating movement of the workpiece is also less than in the case of soft pressing elements known from the prior art.

The force-receiving surface and the force-transmitting surface are preferably formed by sides of a leaf-shaped portion of the intermediate element which face away from one another. A leaf-shaped portion means an intermediate element which has force-receiving surfaces and force-transmitting surfaces which are substantially parallel to each other and are spaced apart by a maximum of 2 mm, in particular a maximum of 1 mm. A leaf-shaped portion of this kind has the advantage that the intermediate element permits planar contact with the rear side of the finishing band which extends beyond a line contact.

The intermediate element is preferably produced from a metallic material, in particular from spring steel. As a result, high pressing forces can be transmitted to a finishing band.

It is further preferred for the force-receiving surface and/or the force-transmitting surface of the intermediate element to have a friction-increasing surface structure (for example a roughening having a peak-to-valley height of at least 0.05 mm) and/or a friction-increasing coating (in particular a diamond layer, preferably galvanically applied). An increase in the friction between the pressing element and the intermediate element and/or between the intermediate element and the finishing band can thereby be achieved. This relieves the finishing band and improves transmission of the oscillating movement.

The intermediate element is preferably produced from a harder material than the pressing portion of a pressing element cooperating with the force-receiving surface of the intermediate element. In this way, higher pressing forces can be provided by means of the intermediate element than by a comparatively soft pressing portion of the pressing element. The treatment times can thereby be shortened. At the same time, however, a pressing force can be applied to the intermediate element in a geometrically flexible manner. Imprecisions in an initial geometry of a workpiece to be treated can thus be compensated within short treatment times.

The pressing portion of a pressing element or an entire pressing element is preferably produced from a plastics material, in particular from an elastomer. A pressing portion of this kind or a pressing element of this kind permits geometrically flexible contact of a pressing surface of the pressing element on the force-receiving surface of the intermediate element.

A pressing element is preferably movable relative to the holding apparatus about an axis which extends in parallel with the force-transmitting surface and in parallel with a direction which is tangential with respect to the workpiece surface to be finished. This type of mounting makes it possible to tilt the pressing element such that the pressing elements can align with the workpiece geometry and such that axial errors in the bearing seats of the workpiece can be compensated.

According to an embodiment of the invention, the force-transmitting surfaces are substantially planar in an undeformed initial state and have a curvature in the same direction as the workpiece surface when a pressing force is transmitted. This provides a particularly good adaptability of the device to workpieces of different diameters.

The intermediate element is fixed, for example, to the holding apparatus in such a way that said element can be more easily retrofitted or also removed again for specific uses for example.

It is also possible to fix the intermediate element to a pressing element, for example if it is desirable to arrange pressing elements on a holding apparatus so as to be replaceable.

Alternatively or in addition thereto, it is possible for the intermediate element to encase a pressing element, which has the advantage that the pressing element and the intermediate element can be provided as a structural unit.

To further shorten the treatment times, it is advantageous for two pressing elements arranged so as to be distributed over a partial circumference of the workpiece surface to be held on the holding apparatus, the intermediate element or a plurality of intermediate elements transmitting pressing forces, which are offset relative to one another in the circumferential direction of the workpiece surface, to the finishing band.

In this context, it is particularly advantageous for the force-transmitting surfaces of the intermediate element or of a plurality of intermediate elements assigned to different pressing elements to be oriented in a substantially V-shaped manner relative to one another.

Two force-transmitting surfaces which are adjacent when viewed in the circumferential direction of the workpiece may span an angle of from approximately 50° to approximately 130°, preferably from approximately 70° to approximately 110°, in particular from approximately 80° to approximately 100°. This makes it possible to treat different workpieces having diameters which differ greatly from one another, for example by up to 10 mm or even by up to 20 mm or even by more than 20 mm.

Particularly high flexibility regarding the diameter range of the workpieces to be treated occurs when the adjacent force-transmitting surfaces are substantially planar at least in an undeformed initial state.

Further improved contact of the finishing band on a workpiece occurs when the holding apparatus is mounted on a carrier such that it can pivot about a pivot axis extending in parallel with a workpiece axis.

In order to gently bring a finishing band into engagement with a workpiece to be finished, it is preferred for spring units to be provided in a central pivot position in order to align the holding apparatus. A preferred position of the holding apparatus relative to the carrier can be defined in this way.

Finally, it is preferred for two holding apparatuses to each be provided with two pressing elements, the total of four pressing elements being arranged so as to be distributed over the circumference of the workpiece surface. In this manner, pressing forces can be transmitted by a finishing band to a workpiece from four different radial directions. In the process, in each case two pressing elements arranged opposite each other act on the workpiece with respective opposing pressing forces in such a way that said workpiece is mounted in a stable manner inside the two holding apparatuses, despite rotation and superimposed oscillation.

An embodiment of a device, denoted overall by reference numeral 10, is used for band finishing a workpiece 12, for example a crankshaft. The workpiece 12 comprises a workpiece axis 14 and a workpiece surface 16 to be finished. A finishing band 18 is provided for treating the workpiece surface 16 and is in contact with the workpiece surface 16 over a partial circumference thereof. The workpiece surface 16 is the bearing seat of a crankshaft for example.

During the finishing thereof, the workpiece 12 is driven by means of known drives. A rotary drive causes the workpiece 12 to rotate about the workpiece axis 14. An oscillating drive moves the workpiece 12 in parallel with the workpiece axis 14 such that they oscillate in opposing directions. By means of the combination of the rotating movement and the oscillating movement, the finishing band 18 produces a cross-grinding structure, characteristic of finishing, by means of the abrasive contact of the front side of the finishing band on the workpiece surface 16.

Figure 8:
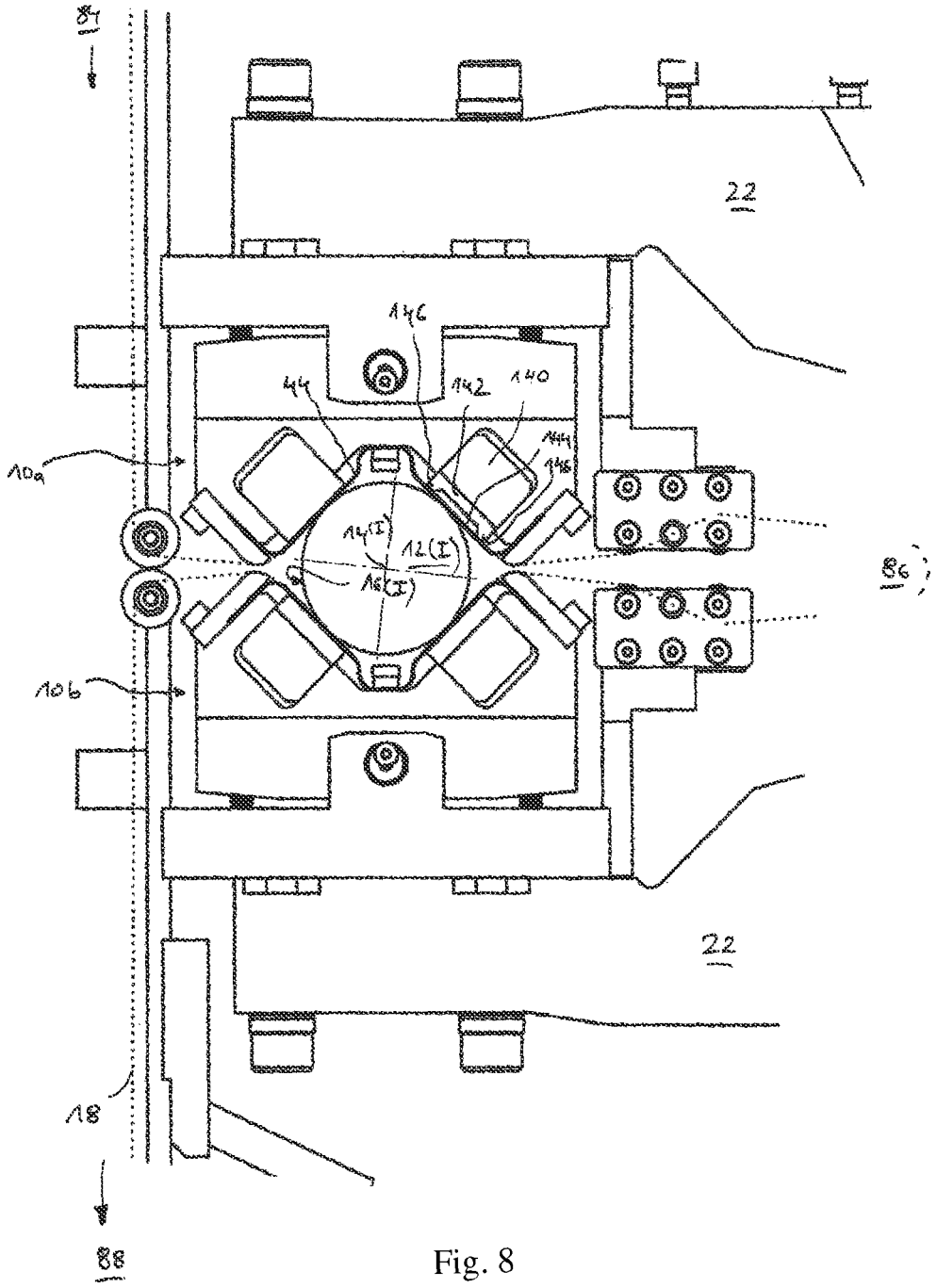
FIG. 8 is a side view of an embodiment of a finishing device when treating a workpiece having a smaller diameter.
Figure 9:
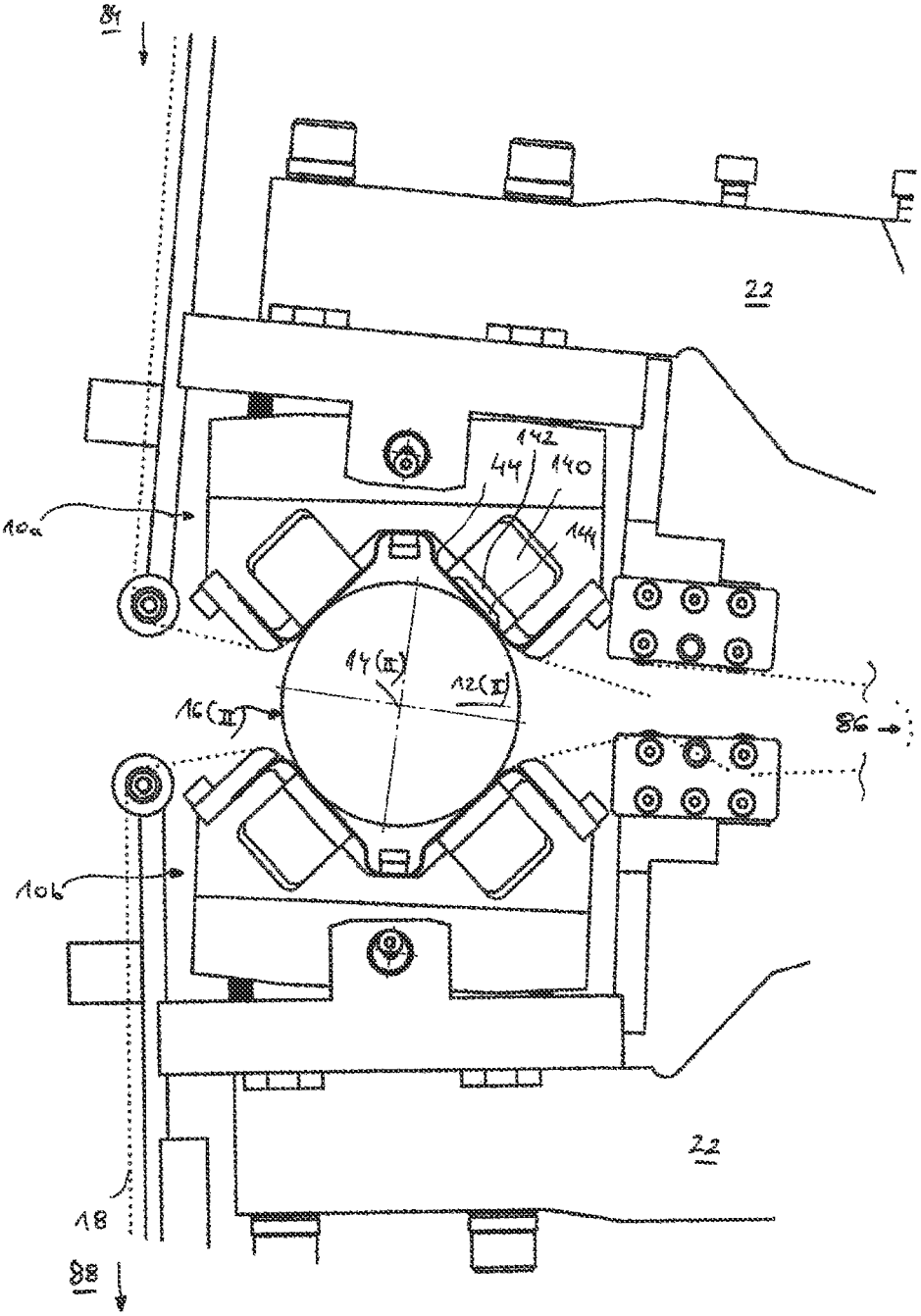
FIG. 9 is a side view corresponding to FIG. 8 when treating a workpiece having a larger diameter.

The device 10 further comprises a carrier 20 for connection to pressing pincers 22 which are shown in portions in FIGS. 8 and 9. The carrier 20 comprises a pivot bearing 24 for mounting a holding apparatus 26 about a pivot axis 28. The holding apparatus 26 is held in a central pivoting position on the carrier 20, specifically by means of spring units 30 and 32 which are arranged on either side of the pivot bearing 24 and each act as compression springs depending on a pivot direction of the holding apparatus 26.

The holding apparatus 26 comprises a dish-shaped holding part 34 having supports 36 which are arranged at an angle to one another and intended for supporting an assembly 38 (shown on its own in FIG. 2).

The assembly 38 comprises a pressing element 40, which is approximately square or cuboid for example and has a pressing portion 42 which points towards the finishing band 18 when arranged in the support 36.

The assembly 38 further comprises an intermediate element 44 which has a leaf-shaped portion 36 which cooperates with the pressing portion 42 of the pressing element 40. The leaf-shaped portion 46 comprises a force-receiving surface 48 which faces the pressing portion 42 and a force-transmitting surface 50 which faces the rear side of the finishing band 18. The leaf-shaped portion 46 is preferably produced from hardened spring steel and preferably has a material thickness of a maximum of 1 mm, in particular a maximum of 0.5 mm.

The intermediate element 44 comprises lateral portions 52 and 54 which extend from the leaf-shaped portion 46 and which, together with the leaf-shaped portion 46, encase the pressing element 40.

Undercut portions 56 and 58 extending from the lateral portions 52, 54 may be provided for fastening the intermediate element 44 to the pressing element 40.

It is conceivable for the assemblies 38 to be fixedly received in in the supports 36 of the holding apparatus 26. However, it is also possible for the assemblies 38 to be mounted so as to be movable relative to the holding apparatus 26 about axes 60. The axes 60 extend perpendicularly to the workpiece axis 14 and in parallel with a plane in which the force-transmitting surface 50 of the intermediate element 44 extends. The assemblies 38 can thus tilt about the axes 60 and align with the geometry of the workpiece 12. It is also possible to compensate axial errors in bearing seats of the workpiece 12.

Figure 7:
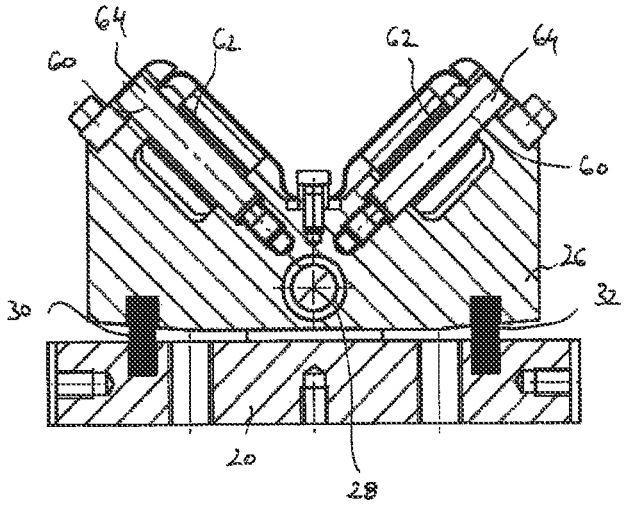
FIG. 7 is a sectional view of the device according to FIG. 6.

In the configuration of the above-described tilted mounting, it is possible for the pressing elements (and optionally also the intermediate element 44) to comprise an opening 62 which extends in parallel with the axis 60 and through which a bearing pin 64 (shown in FIG. 7 for example) passes.

The holding apparatus 26 is used in addition for fastening band guide elements 66 and 68, respectively, having rounded band guide surfaces, for example a band introduction surface 70 and a band removal surface 72.

Fastening elements, for example screws 74 (cf. FIG. 4), can also be provided for fastening the intermediate element 44 to the pressing element 40.

During the finishing of the workpiece 12, the finishing band 18 is pressed against the workpiece surface 16 of the workpiece 12 by means of the assemblies 38. In this case, a pressing force provided by a pincer arm 22 is transmitted to the assemblies 38 via the carrier 20 and the holding apparatus 26.

The pressing element 40 transmits a pressing force to the force-receiving surface 48 of the leaf-shaped portion 46 of the intermediate element 44 by means of the pressing portion 42. Said intermediate element in turn transmits the pressing force to a rear side of the finishing band 18 by means of the force-transmitting surface 50, which finishing band then cooperates, by means of a front side having an abrasive effect, with the workpiece surface 16 of the workpiece 12.

The assemblies 38 generate pressing forces acting in the radial direction, that is to say pressing forces which are directed towards the workpiece axes 14 of the workpiece 12.

The pressing element 40 of the assembly 38 is produced for example from a plastics material, preferably an elastomer. A suitable plastics material is polyester urethane rubber, which is also known by the trade name "Vulkollan" of Bayer AG, Leverkusen, Germany. In this case, it is possible for the entire pressing element 40 to be produced from a softer material than the intermediate element 44, as shown in FIGS. 1 to 3 for example. However, it is also possible for just a pressing portion 42 of the pressing element 40 to be produced from a softer material than the leaf-shaped portion 46 of the intermediate element 44 (cf. FIG. 4).

In a further embodiment of a pressing element 140 which can be used for a device 10 (cf. FIGS. 8 and 9), a pressing portion 142 is provided which comprises a clearance 144 facing the force-receiving surface 48 of the intermediate element 44. Viewed in the extension direction of the finishing band 18, the clearance 144 is laterally delimited by superelevated portions 146 and permits flexurally resilient yielding of the intermediate element 44 into the clearance 144.

The leaf-shaped portion 46 of the intermediate element 44 extends in a straight plane in an undeformed initial state. When the pressing element 40 and the intermediate element 44 press against the workpiece surface 16, the leaf-shaped portion 46 deforms in a flexurally resilient manner, such that the leaf-shaped portion 46, and thus also the force-transmitting surface 50, curve according to the curvature of the workpiece surface 16. In this manner, the contact region between the leaf-shaped portion 46 and the finishing band 18, and thus between the finishing band 18 and the workpiece surface 16, can be increased.

In the embodiments described above, one intermediate element 44 is associated with one pressing element 40 in each case. It is also possible for one intermediate element 44 to be provided, which is associated with a plurality of pressing elements 40, preferably exactly two pressing elements 40. This will be described in the following, with reference to an embodiment shown in FIGS. 6 and 7.

Figure 6:
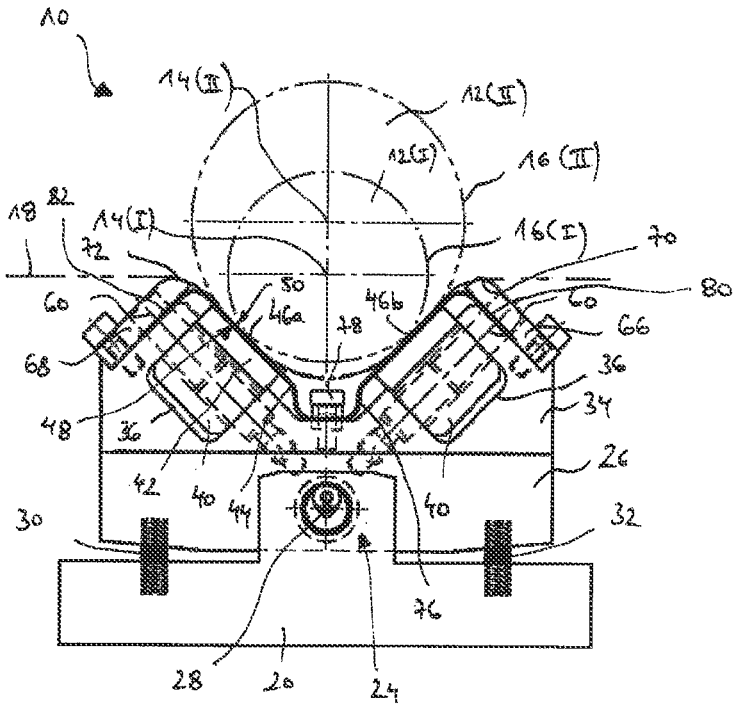
FIG. 6 is a side view of a further embodiment of a device for finishing a workpiece.

One intermediate element 44 which is associated with a plurality of pressing elements 40 comprises a number of leaf-shaped portions 46 which corresponds to the number of pressing elements 40, for example a first leaf-shaped portion 46*a* and a second leaf-shaped portion 46*b* which is provided spatially separately therefrom (cf. FIG. 6). The portions 46*a* and 46*b* are interconnected by means of a connecting portion 76 which is spaced apart from a workpiece surface 16 to be treated. The connecting portion 76 is preferably connected to the holding apparatus 26 by means of a connecting element 78.

The portions 46*a* and 46*b* each comprise end portions, 80 and 82 respectively, on the side thereof facing away from the connecting portion 76. The end portions 80 and 82 are also arranged so as to be spaced apart from the workpiece surface 16 to be treated and are in turn preferably fixed to the holding apparatus 26, for example by means of the bearing pins 64 which also provide the above-described tilted mounting of the pressing elements 40 relative to the holding apparatus 26.

The respective force-transmitting surfaces 50 of the leaf-shaped portions 46*a* and 46*b* each extend in straight planes. Said planes are oriented at an angle of 90°+/−20°, in particular of 90°+/−10°, relative to one another. This angled arrangement of the straight planes makes it possible to treat workpieces 12 of different diameters. This is shown in FIG. 6 on the basis of a smaller workpiece 12(I) and on the basis of a larger workpiece 12(II).

Preferably, two of the above-described devices 10 are used for finishing a workpiece 12, which devices are each connected to a pincer arm 22 (cf. FIGS. 8 and 9). In this case, it is possible to use a common finishing band 18 which is fed from a finishing band supply 84 to a first device 10*a* and via a deflection 86 to a second device 10*b*, and finally to a finishing band collector 88.

The pincer arms 22 are pivotally mounted in a manner known per se. For treating a comparatively small workpiece 12(I), the pincer arms 22 have a smaller spacing relative to each other at the height of the workpiece 12(I) than when treating a comparatively larger workpiece 12(II) (cf. FIGS. 8 and 9).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A device for finishing a workpiece having a workpiece axis and a workpiece surface, the device comprising:

two pressing elements;

a holding apparatus configured to hold the pressing elements such that the pressing elements are distributed about a partial circumference of the workpiece surface;

a finishing band that is pressable against the workpiece surface by the pressing elements; and a flexurally resilient intermediate element disposed so as to transmit a pressing force from at least one of the pressing elements to the finishing bad by means of a force-receiving surface and by means of a force-transmitting surface, the intermediate element or a plurality of the intermediate elements being configured to transmit pressing forces, which are offset relative to one another in a circumferential direction of the workpiece surface, to the finishing band, the force-transmitting surfaces of the intermediate element or of the plurality of intermediate elements assigned to different ones of the pressing elements being oriented in a substantially V-shaped manner relative to one another, the force-transmitting surfaces being planar in an undeformed initial state and having a curvature in a same direction as the workpiece surface in a state in which the pressing force is transmitted.

2. The device according to claim 1, wherein the intermediate element comprises a leaf-shaped portion, sides of which face away from one another and comprise the force-receiving surface and the force-transmitting surface.

3. The device according to claim 1, wherein the intermediate element comprises a metallic material.

4. The device according to claim 3, wherein the metallic material comprises spring steel.

5. The device according to claim 1, wherein at least one of the force-receiving surface or the force-transmitting surface of the intermediate element has at least one of a friction-increasing surface structure or a friction-increasing material coating.

6. The device according to claim 1, wherein at least one of the pressing elements has a pressing portion cooperating with the force-receiving surface of the intermediate element, and wherein the intermediate element comprises a harder material than the pressing portion of the at least one pressing element.

7. The device according to claim 6, wherein at least the pressing portion of the at least one pressing element comprises a plastics material.

8. The device according to claim 7, wherein the plastics material comprises an elastomer.

9. The device according to claim 1, wherein at least one of the pressing elements is movable relative to the holding apparatus about an axis which extends in parallel with the force-transmitting surface and in parallel with a tangential direction with respect to the workpiece surface.

10. The device according to claim 1, wherein the intermediate element is fixed to the holding apparatus.

11. The device according to claim 1, wherein the intermediate element is fixed to at least one pressing element.

12. The device according to claim 1, wherein the intermediate element encases at least one pressing element.

13. The device according to claim 1, wherein the force-transmitting surfaces span an angle of from approximately 50° to approximately 130°.

14. The device according to claim 1, wherein the force-transmitting surfaces span an angle of from approximately 70° to approximately 110°.

15. The device according to claim 1, wherein the force-transmitting surfaces span an angle of approximately 80° to approximately 100°.

16. The device according to claim 1, wherein the holding apparatus is pivotally mounted on a carrier about a pivot axis extending in parallel with the workpiece axis.

* * * * *